US006269561B1

(12) United States Patent
Cummings

(10) Patent No.: US 6,269,561 B1
(45) Date of Patent: Aug. 7, 2001

(54) TILTABLE IMPLEMENT FOR EXCAVATOR MACHINES AND THE LIKE

(75) Inventor: David C. Cummings, Charlotte, NC (US)

(73) Assignee: Rockland Inc., Bedford, PA (US)

( * ) Notice: Subject to any disclaimer, the term of this patent is extended or adjusted under 35 U.S.C. 154(b) by 0 days.

(21) Appl. No.: 09/437,057

(22) Filed: Nov. 9, 1999

(51) Int. Cl.[7] ..... E02F 3/00

(52) U.S. Cl. ..... 37/466; 37/444; 414/692; 414/705; 414/716; 414/697

(58) Field of Search ..... 37/444, 443, 442, 37/411, 461, 184, 185, 186, 403, 406, 409, 410, 468, 466; 414/697, 716, 705, 692; 91/468, 512, 516, 535, 437; 60/494

(56) References Cited

U.S. PATENT DOCUMENTS 3,631,762 * 1/1972 Fuzzell ..... 91/411 R
3,770,322 * 11/1973 Cobb et al. ..... 299/37
3,774,954 * 11/1973 Taguchi et al. ..... 294/70
4,639,183 * 1/1987 Guthoff ..... 414/705
5,375,348 * 12/1994 Kishi ..... 37/186
5,473,828 * 12/1995 Kishi ..... 37/187
6,120,237 * 9/2000 Cummings et al. ..... 414/729

* cited by examiner

*Primary Examiner*—Victor Batson
(74) *Attorney, Agent, or Firm*—Lalos & Keegan

(57) ABSTRACT

A tool assembly mountable on the handle of a material working machine generally including a link mountable on the machine handle for pivotal movement about a first axis and connectable to a fluid actuated assembly connected to the machine handle, operable for displacing the link about such first axis, an implement connected to the link for pivotal movement about a second axis, a first fluid actuated assembly operatively interconnecting the link and the implement, a second fluid actuated assembly operatively interconnecting the link and the implement, a first fluid line intercommunicating a base end of the cylinder of the first fluid actuated assembly and one of the base and rod ends of the cylinder of the second fluid actuated assembly, a second fluid line intercommunicating a rod end of the cylinder of the first fluid actuated assembly and the other of the base and rod ends of the cylinder of the second fluid actuated assembly and a valve disposed in one of the fluid lines, operable to be selectively disposed in open and closed conditions whereby the opening of such valve permits the implement to be tilted relative to the machine handle and the closing of the valve function to fix the angle of the bucket relative to the machine handle.

16 Claims, 5 Drawing Sheets

TILTABLE IMPLEMENT FOR EXCAVATOR MACHINES AND THE LIKE

This invention relates to a tool assembly for an excavator machine and the like, and more particularly to an implement assembly for such machines having improved means for tilting the assembly for performing various work functions.

BACKGROUND OF THE INVENTION

In many excavating operations utilizing a bucket mounted on the end of a machine handle, it often is required or desired to tilt the excavating bucket in order to perform various types of operations. Typically, the tilting of such buckets has been provided by the use of one or more hydraulic cylinder assemblies. Such assemblies have been operated by means of a hydraulic pump normally located on the base of the machine, sets of fluid lines running along the boom and connected handle of the machine to the cylinder assemblies and appropriate controls located at the operator's station of the machine.

Such type of arrangement, however, has a number of disadvantages in terms of manufacturing, operating and maintenance costs. The requirement of a pump, supply and return fluid lines, various fittings and controls obviously adds to initial manufacturing costs. The use of energy for operating the pump adds to the operating costs. Leakage of the various components of such systems further increases maintenance costs. Furthermore, unless the supply and return lines of such systems running along the boom and handle of such machines are adequately sheltered, such lines are vulnerable to damage in the use of the machine which not only results in repair costs but machine down time. It thus has been found to be desirable and the principal object of this invention to provide a tiltable implement assembly for an earth working or material handling machine which abates if not eliminates the aforementioned disadvantages attendant to comparable prior art arrangements.

SUMMARY OF THE INVENTION

The aforementioned disadvantages of prior art arrangements are overcome by the use of a tool assembly mountable on the handle of a machine of the type described generally consisting of a link mountable on the handle of the machine for pivotal movement about a first axis and connectable to a fluid actuated assembly connected to the machine handle, operable for displacing the link about such first axis, an implement connected to the link for pivotal movement about a second axis, a first hydraulic cylinder assembly operatively interconnecting the link and the implement, a second hydraulic cylinder assembly interconnecting the link and the implement, a first fluid line intercommunicating a base end of the cylinder of the first hydraulic cylinder assembly and one of the base and rod ends of the cylinder of the second hydraulic cylinder assembly, a second fluid line intercommunicating a rod end of the cylinder of the first hydraulic cylinder assembly and the other of the base and rod ends of the cylinder of the second hydraulic cylinder assembly, and a valve disposed in one of such fluid lines, operable to be selectively disposed in open and closed conditions. In the use of such an assembly, the angle of the implement relative to the handle of the machine may be adjusted and set merely by operating the control valve to open the valve of the system, permitting free communication of fluid between the base ends of the cylinders interconnecting the link and the implement or the base end of the cylinder of one of such assemblies with the rod end of the cylinder of the other assembly, maneuvering the boom and handle of the machine to cause the implement to engage the ground and become pivotally displaced about the pivot axis of the implement relative to the connecting link, and then operating the controls of the system to close the valve in the fluid line intercommunicating the two cylinder assemblies to lock such assemblies and thus fix the angular position of the implement relative to the connected link.

DETAIL DESCRIPTIONS OF EMBODIMENTS OF THE INVENTION

The present invention is intended for use with excavating machines and the like generally consisting of a main frame normally equipped with wheels or crawler units for transporting the machine, a support frame or platform mounted on the main frame and pivotal relative to the main frame about a vertical axis, a boom mounted on the support frame for pivotal movement about a horizontal axis, a hydraulic cylinder assembly interconnecting the support frame and the boom operable to lift or lower the boom, a handle connected to the boom for pivotal movement relative to the boom about a horizontal axis, a hydraulic cylinder assembly operatively interconnecting the boom and the handle for angularly displacing the handle relative to the boom about the axis of the pivotal connection therebetween, an implement assembly mounted on the handle for pivotal movement relative to the handle about the axis of the pivotal connection therebetween, a hydraulic cylinder assembly operatively interconnecting the handle and the implement assembly, a hydraulic system for supplying fluid under pressure to the various cylinder assemblies for operating them and suitable controls for controlling the supply of pressurized fluid to the various cylinder assemblies. Such machines are typically operated by an operator located at an operator's station in a cab provided on the support frame of the machine to maneuver the implement assembly to perform various work functions such as excavating and the like.

Figure 1:
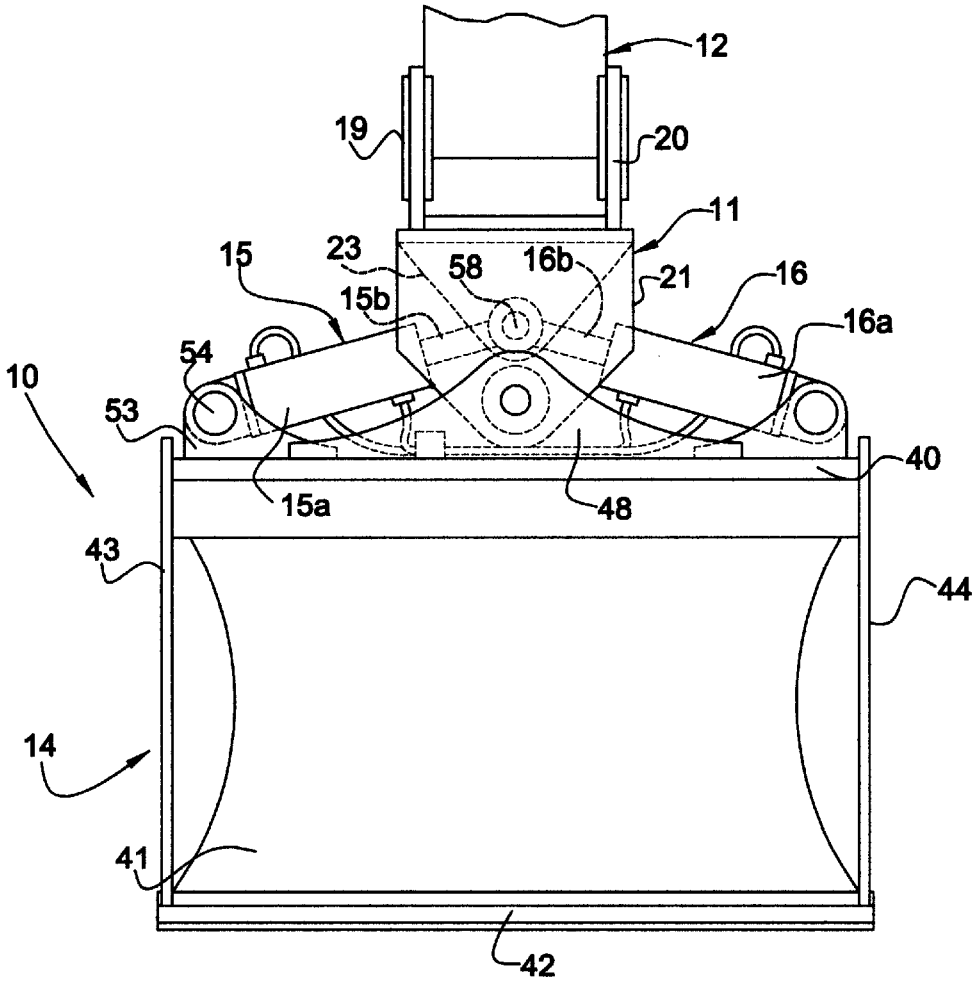
FIG. 1 is a front, elevational view of a tiltable bucket assembly mounted on the handle of a machine, embodying the present invention.
Figure 2:
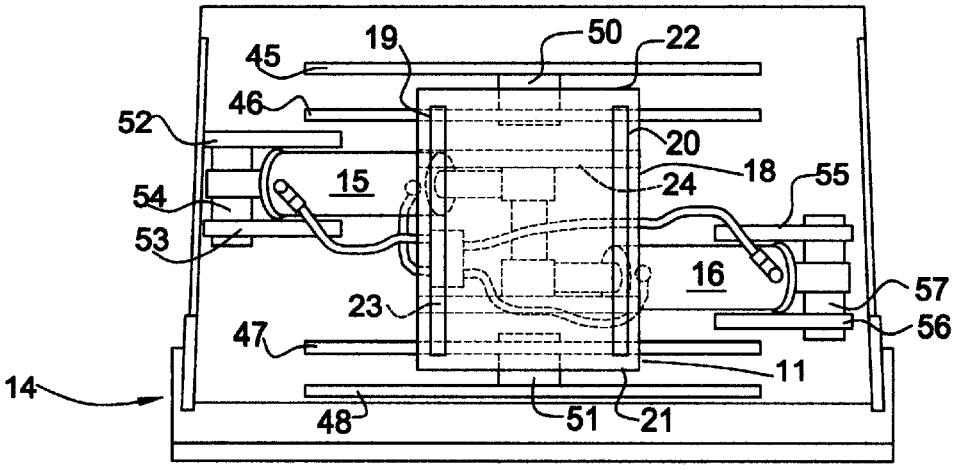
FIG. 2 is a top plan view of the assembly shown in FIG. 1.
Figure 3:
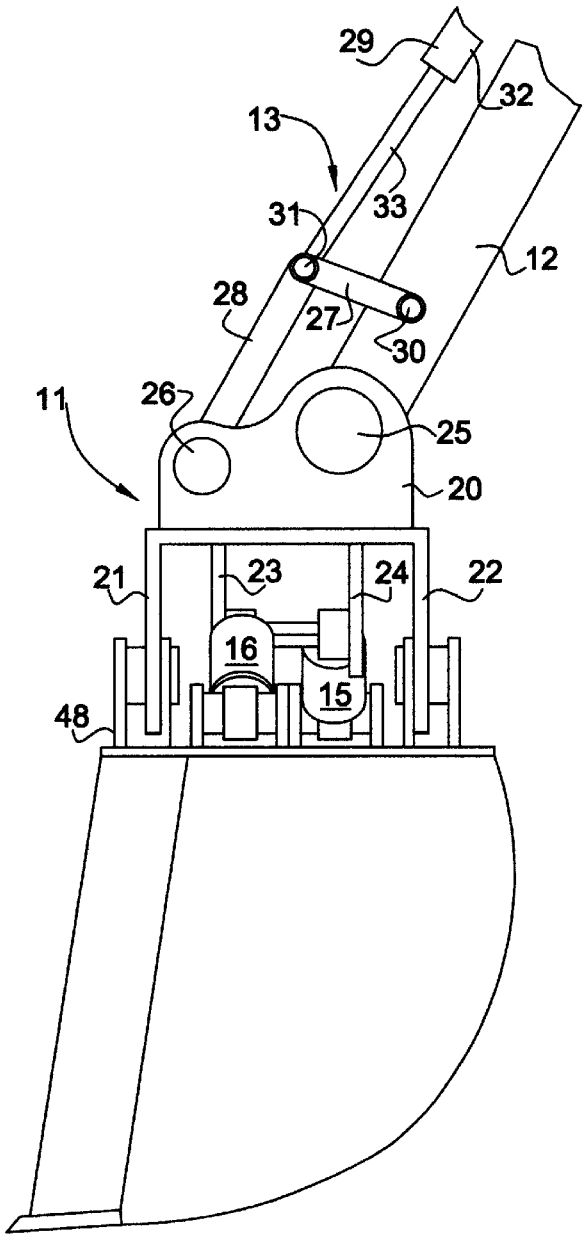
FIG. 3 is a side elevational view of the assembly shown in FIGS. 1 and 2.
Figure 3A:
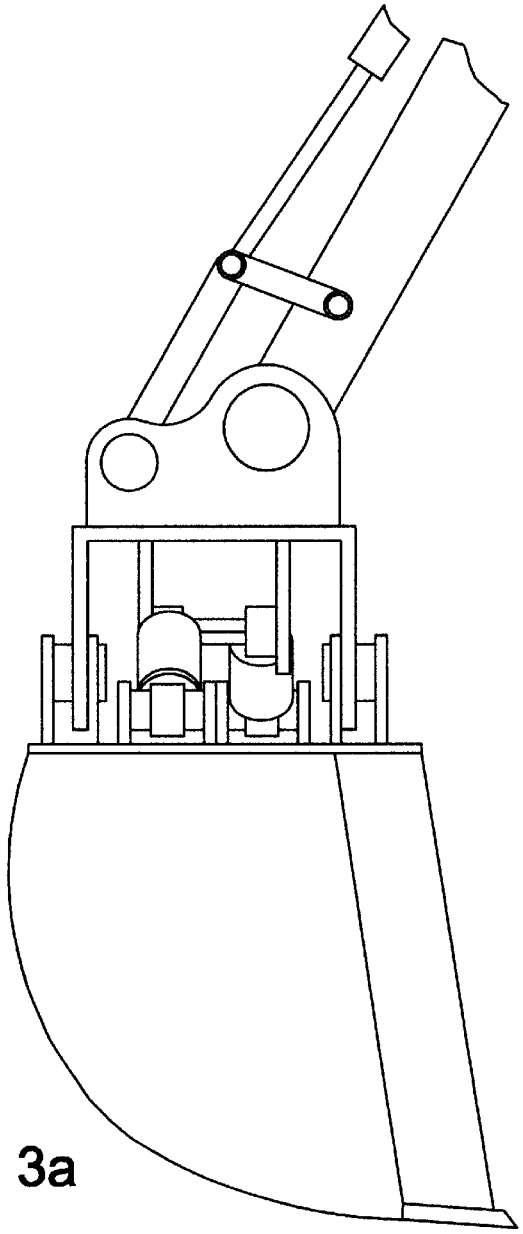
Figure 4:
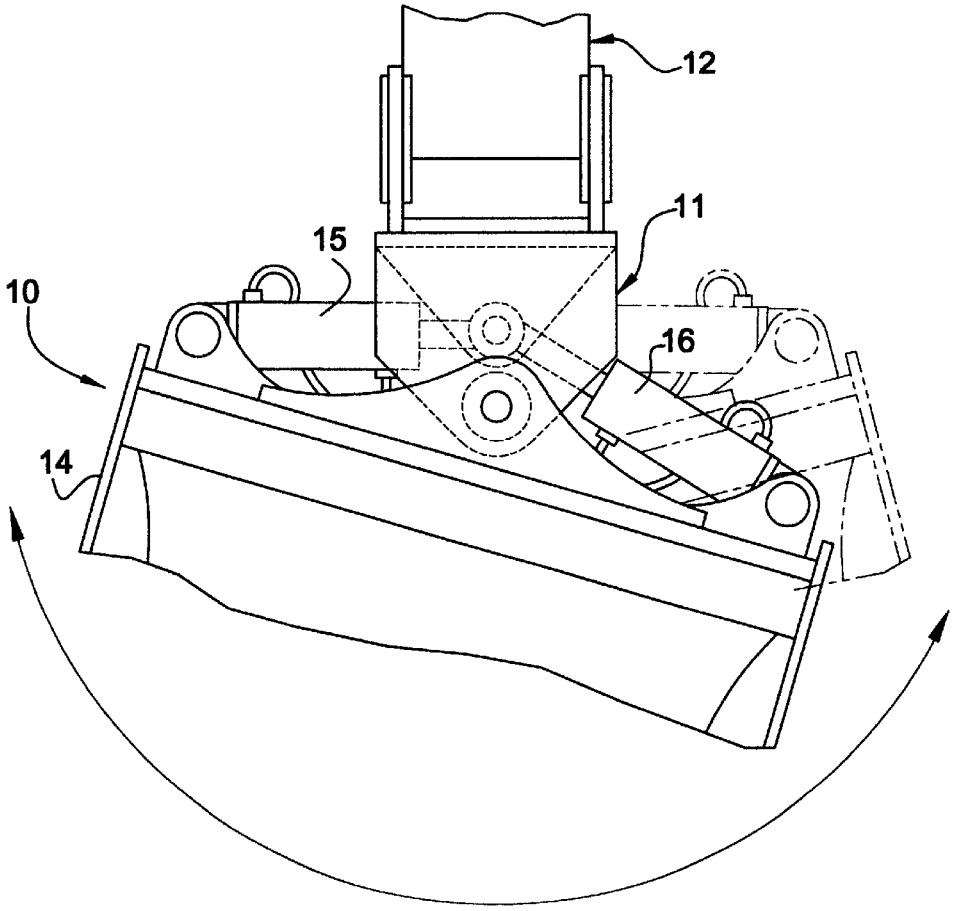
FIG. 4 is a view similar to the view shown in FIG. 1, illustrating the bucket of the assembly angularly displaced relative to the position shown in FIG. 1, and having a portion of the bucket broken away.
Figure 5:
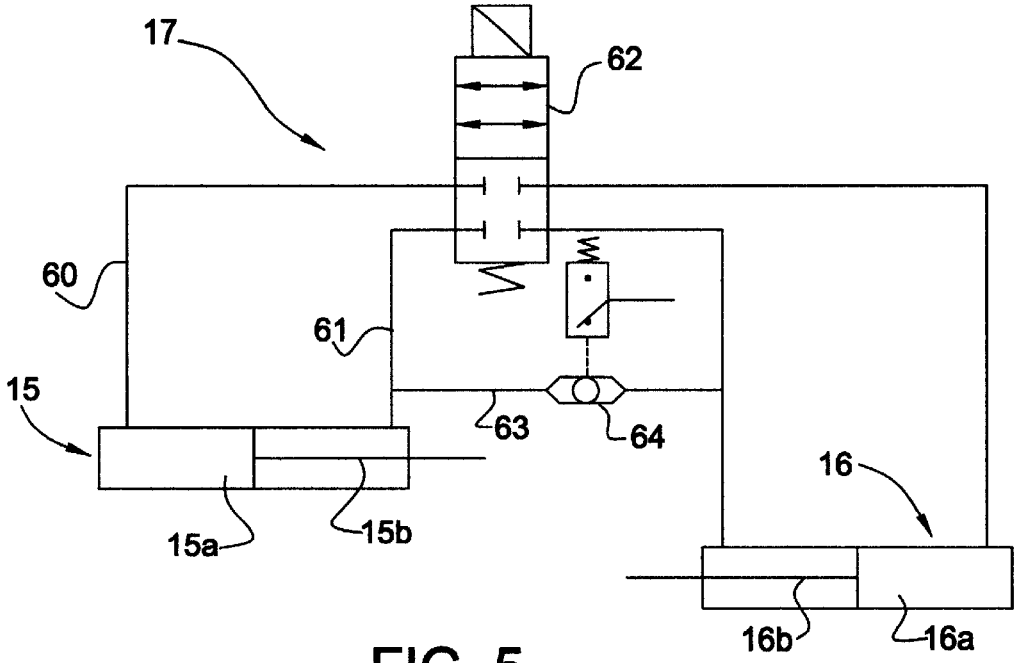
FIG. 5 is a schematic of the fluid system of the assembly shown in FIGS. 1 through 4.

Referring to FIGS. 1 through 5, there is illustrated a tiltable bucket assembly 10 embodying the present invention. The assembly generally includes a link 11 pivotally connected to a handle 12 of a machine for pivotal movement relative to the handle about a first axis and connected to an actuating assembly 13 for displacement of the link relative to the handle about such first axis, an excavating bucket 14 pivotally connected to link 11 for pivotal movement about a second axis disposed substantially at a right angle relative to such first axis, a pair of hydraulic cylinder assemblies 15 and 16 operatively interconnecting the link and portions of the bucket disposed on opposite sides of such second axis and a fluid control system 17. As best seen in FIGS. 1 and 2, link 11 includes an upper plate member 18 having a pair of upwardly extending laterally spaced brackets 19 and 20, a pair of depending, longitudinally spaced end brackets 21 and 22 and a pair of longitudinally spaced, brackets 23 and 24, spaced depending inwardly of end brackets 21 and 22. Brackets 19 and 20 are provided with a set of transversely aligned openings which are adapted to receive a connecting pin 25 for pivotally connecting link 11 to handle 12 for pivotal movement of the link relative to the handle about such first axis. The forward ends of brackets 19 and 20 are provided with a set transversely spaced openings adapted to receive a connecting pin 26 for pivotally connecting the forward end of the link to assembly 13. As best shown in FIG. 3, assembly 13 includes a support link 27, a connecting link 28 and a hydraulic cylinder assembly 29. Connecting link 27 is pivotally connected to handle 12 by means of a connecting pin 30. Connecting link 28 is pivotally connected to the front end of link 11 by means of a connecting pin 26 and is connected at its opposite end to support link 27 by means of a connecting pin 31. Cylinder assembly 29 consists of a cylinder member 32 pivotally connected at its base end to brackets on the upper end of the handle (not shown) and a rod member 33 pivotally connected to connecting pin 31.

Bucket 14 is of a generally conventional construction and includes an upper wall 40, a downwardly and forwardly projecting rear wall 41 terminating at a transversely disposed cutting edge 42 and a pair of side walls 43 and 44. As best shown in FIGS. 1 and 2, the upper wall of the bucket is provided with a first set of rearwardly displaced, transversely disposed brackets 45 and 46, and a pair of forwardly displaced, transversely disposed brackets 47 and 48. Bucket 14 is pivotally connected to link 11 by means of a connecting pin 50 received within longitudinally aligned openings in brackets 45 and 46 of the bucket and depending bracket 22 of link 11, and a connecting pin 51 disposed in longitudinal alignment with connecting pin 50 and received within aligned openings in brackets 47 and 48 of the bucket and depending bracket 21 of link 11.

As best seen in FIG. 2, upper wall 40 of the bucket is provided with a first set of brackets 52 and 53 on one side thereof provided with a longitudinally disposed pin 54, and a second set of brackets 55 and 56 on the other side thereof provided with a longitudinally disposed connecting pin 57. Cylinder assembly 15 includes a cylinder member 15*a* connected at its base end to connecting pin 54 and a rod member 15*b* connected to a connecting pin 58 received within longitudinally aligned openings in depending brackets 23 and 24. Similarly, cylinder assembly 16 consists of a cylinder member 16*a* connected at its base end to connecting pin 57, and a rod member 16*b* connected at its free end to connecting pin 58. With such an arrangement, it will be appreciated that pivotal movement of the bucket relative to link 11 about the axis of connecting pins 50 and 51 will cause the rod members of assemblies 15 and 16 to displace relative to the cylinder members thereof.

Hydraulic system 17 consists merely of a fluid line 60 intercommunicating the base ends of cylinders 15*a* and 16*a*, a fluid line 61 intercommunicating the rod ends of cylinders 15*a* and 16*a*, a solenoid valve 62 disposed in line 60 or 61 which is operable in open and closed positions to correspondingly permit and preclude free communication between the base and rod ends of cylinders 15*a* and 16*a*, and a fluid line 63 connected to fluid line 61, in parallel with valve 62, having a valve 64 normally disposed in a closed position and operable to open responsive to a certain pressure in fluid line 61 to bypass valve 62 and allow free communication between the respective ends of the cylinder assemblies. Solenoid valve 62 is electrically connected through electrical lines running along the handle and boom of the machine to an electrical power source on the support frame of the machine. The operation of such valve is controlled by suitable electrical controls located at the operator's station of the machine. It will be appreciated that the operator may control solenoid valve 62 to either open or close valve 62 by the use of such controls at the operator's station.

In the operation of the embodiment as described for adjusting and fixing the angle of the bucket relative to the handle, the operator first operates the electrical controls for solenoid valve 62 to open the valve and thus allow free communication of fluid between the base ends of cylinder members 15*a* and 16*a* and between the rod ends thereof. The bucket will then be free to swing or otherwise be pivoted relative to the handle about the axis of connecting pins 50 and 51. With the bucket thus released and free to pivot relative to link 11, other controls are operated by the operator to cause the boom and handle of the machine to be displace and thus cause the bucket to engage the ground and displace angularly relative to link 11 about the axis of connecting pins 50 and 51. When the bucket has been angularly displaced relative to link 11 at the angle desired, the operator then operates the electrical controls for valve 62 to cause it to close and thus preclude the free flow of fluid through line 60 between the base ends of cylinder members 15*a* and 16*a* and through line 61 between the rod ends of the cylinder assemblies. Under such conditions, the position of the bucket relative to link 11 will be locked at the desired angle. The machine operator may then proceed to operate the front end of the machine to perform the desired excavating operation with the bucket tilted at the adjusted angle. Whenever it is desired to change the angle of the bucket relative to link 11 or perhaps return the bucket to its normal operating position, the aforementioned procedure is repeated to either move the bucket to the new angle or allow it to hang freely in a position aligned with the handle where it again may locked into position.

Figure 6:
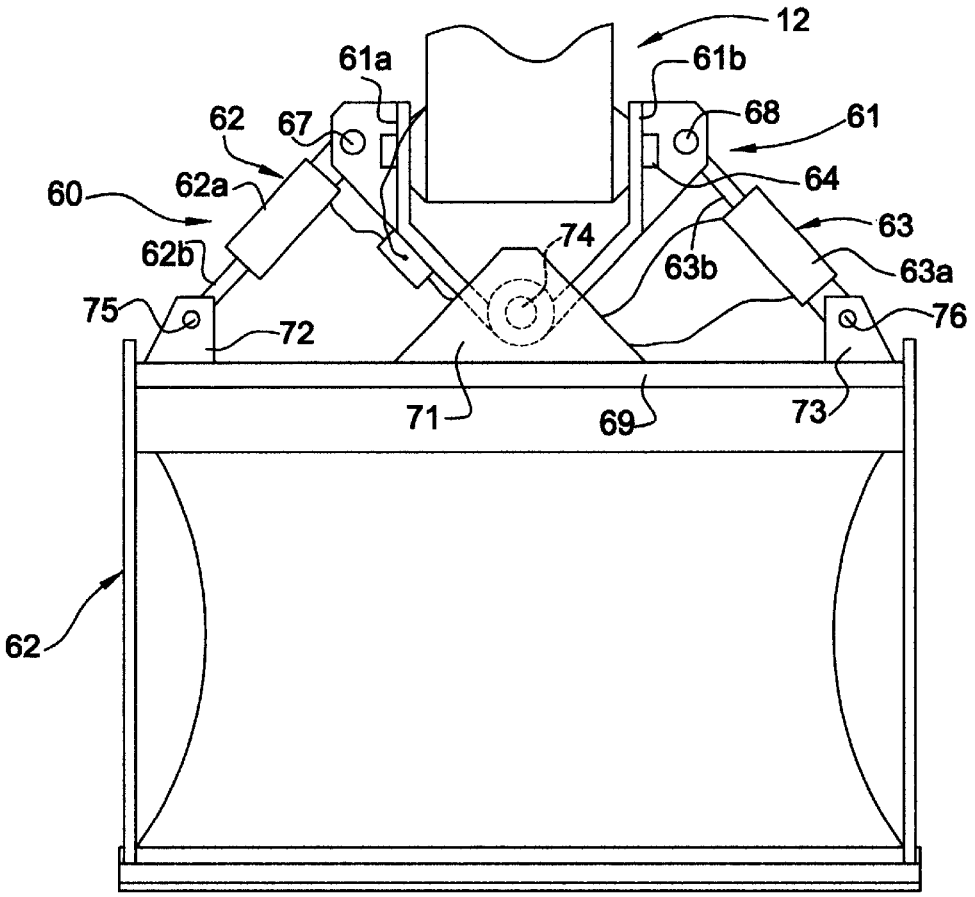
FIG. 6 is a front elevational view of a tiltable bucket assembly mounted on the handle of the machine, incorporating another embodiment of the present invention.
Figure 7:
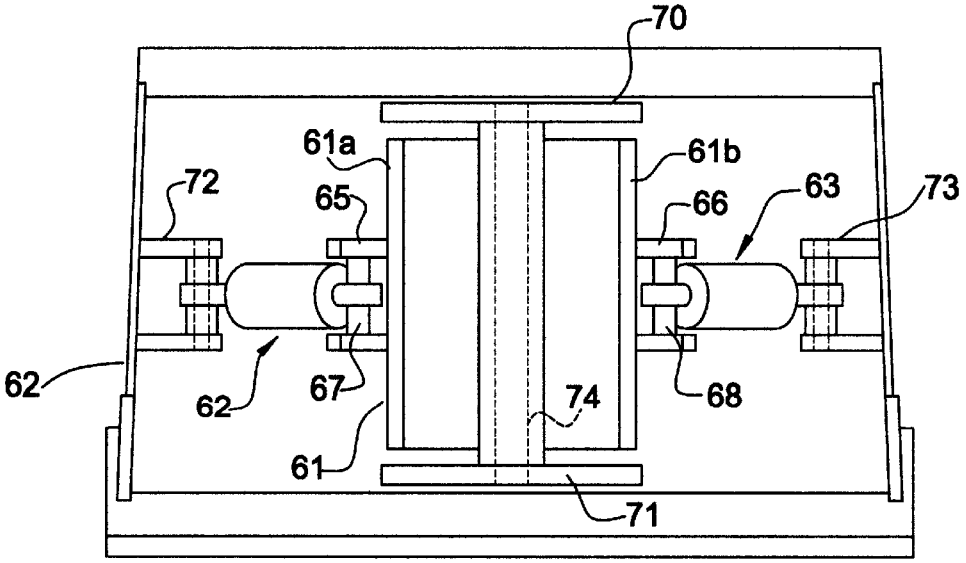
FIG. 7 is a top plan view of the assembly shown in FIG. 6.
Figure 8:
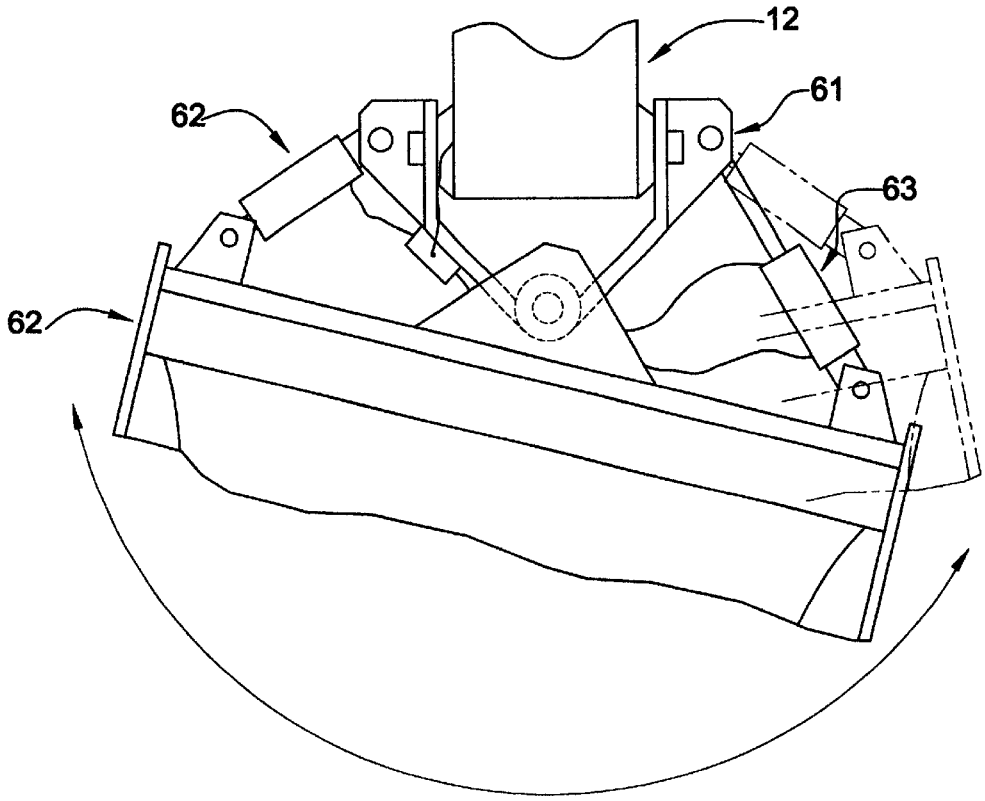
FIG. 8 is a view similar to the view shown in FIG. 6, illustrating the bucket of such assembly angularly displaced relative to the bucket position shown in FIG. 6, and having a portion of the bucket broken away.

FIGS. 6 through 8 illustrate another embodiment of the invention. The embodiment consists of a tiltable bucket assembly 60 mountable on a machine handle 12, operable to be pivoted relative to the handle about a first axis by means of an assembly comparable to assembly 13 (not shown) drawings in order to more clearly depict the components of assembly 60. The assembly consists of a link 61 pivotally connected to the handle and the assembly for pivoting the link relative to the handle, a bucket 62 pivotally connected to link 61 for pivotal movement about a second axis, a pair of cylinder assemblies 62 and 63 operatively interconnecting the link with the bucket and a fluid system 64. Link 61 has a substantially U-shaped configuration with arm portions 61*a* and 61*b* having transversely aligned openings for receiving a connecting pin 64 therethrough pivotally connecting link 61 to handle 12. A connecting link comparable to link 28 shown in FIG. 3 is pivotally connected to a portion of link 60 to pivot the link about the axis of connecting pin 64 in a manner similar to the previously described embodiment. The arm portions of link 61 further are provided with laterly projecting sets of brackets 65 and 66 provided with longitudinally disposed connecting pins 67 and 68.

Bucket 62 is similar in configuration to previously described bucket 14 and includes an upper wall 69 having a pair of longitudinally spaced, transversely disposed brackets 70 and 71, and a pair of transversely spaced sets of brackets 72 and 73 which are transversely aligned with sets of brackets 65 and 66. Bucket 62 is connected to link 61 by means of a connecting pin 74 received within longitudinally aligned openings in brackets 70 and 71 and an intermediate portion of link 61.

The axis of connecting pin 74 lies in a plane disposed at a right angle to the axis of connecting pin 64 and including the center line of handle 12 to permit pivotal movement of link 61 and bucket 62 about the axis of connecting pin 64 and the pivotal movement of bucket 62 relative to link 61 about the axis of connecting pin 74.

Figure 9:
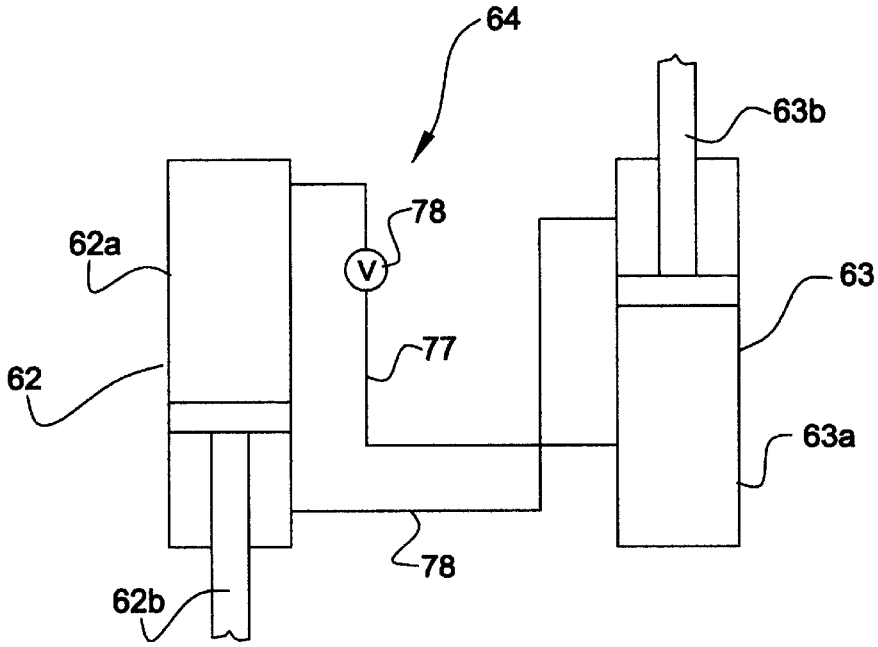
FIG. 9 is a schematic of the fluid system of the embodiment shown in FIGS. 6 through 8.

Cylinder assemblies 62 and 63 operate in essentially the same manner as cylinder assemblies 15 and 16 described in connection with the previous embodiment. The cylinder assembly 62 consists of a cylinder member 62*a* connected at its base end to an arm portion of link 61 by means of a connecting pin 67, and a rod member 62*b* connected to the other arm portion of link 61 by means of a connecting pin 75. Cylinder assembly 63 is reversed in position relative to cylinder assembly 62 and includes a cylinder member 63*a* connected to bracket set 73 by means of a connecting pin 76, and a rod member 63*b* connected to connecting pin 68. As best shown in FIG. 9, the fluid system for such cylinder assemblies includes a first fluid line 77 intercommunicating the base ends of cylinder members 62*a* and 63*a*, a fluid line 78 intercommunicating the rod ends of cylinder members 62*a* and 63*a* and a solenoid valve 78 disposed in fluid line 77. Valve 78 is similar in construction and operation to solenoid valve 62 described in connection with the previously described embodiment, and can be operated to either open and thus allow free communication of fluid between the base ends of the cylinder assemblies and also the rod ends of such assemblies or close and thus preclude such free flow of fluid thus locking the position of the bucket relative to the link 61 as in the previously described embodiment. Valve 78 also is electrically connected to an electrical power source on the machine and is adapted to be operated by suitable controls located at the operator's station on the machine. Furthermore, to compensate for the disparity of chamber volumes on opposite sides of the piston heads in the cylinders, conventional accumulators may be used in the conventional manner to take up or make up fluid in the various chambers of the cylinder assemblies.

As in the previously described embodiment, valve 78 of assembly 60 may be open to allow bucket 62 to tilt relative to link 61 as shown in FIG. 8, to set the angle of the bucket relative to link 61, and may be closed to fix the position of the bucket relative to link 61 by precluding intercommunication of fluid between the cylinder assemblies and thereby locking them in position. The bucket in any angular position relative to link 61 may be operated in the conventional manner by operating the assembly comparable to assembly 13 described in connection with the previously described embodiment to pivot the bucket and link 61 about the axis of connecting pin 64.

By the use of the set up cylinder assemblies interconnecting the bucket and a link pivotally connected to the handle of the machine, providing intercommunication between the chambers of the cylinder members of such assemblies and further providing for electrical control means for allowing or precluding such intercommunication of fluid between such chambers, costly hydraulic supply and return lines running from the base of the machine and along the boom and handle of the machine to tilting cylinders are eliminated along with their expensive installation and maintenance costs. All that is required is an electrical lead line running along the boom and handle of the machine which may be easily installed and effectively sheltered to protect it from damage. Furthermore, any severance of such electrical line may be easily and quickly repaired without the occurrence of any fluid leakage as in conventional systems utilizing hydraulic fluids for operating tilt cylinders.

From the foregoing detailed description it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A tool assembly mountable on a handle of a material working machine comprising:

a link mountable on said handle for pivotal movement about a first axis and connectable to a fluid actuated assembly connected to said handle, operable for displacing said link about said first axis;

an implement connected to said link for pivotal movement about a second axis;

a first fluid actuated cylinder assembly having a cylinder and a rod operatively interconnecting said link and said implement;

a second fluid actuated assembly having a cylinder and a rod operatively interconnecting said link and said implement;

a first fluid line intercommunicating a base end of the cylinder of said first fluid actuated assembly and one of the base and rod ends of the cylinder of said second fluid actuated assembly;

a second fluid line intercommunicating a rod end of the cylinder of said first fluid actuated assembly and the other of the base and rod ends of the cylinder of said second fluid actuated assembly;

a valve disposed in at least one of said fluid lines, operable to be selectively disposed in open and closed conditions; and wherein said implement is free to be angularly displaced relative to said link about said second axis when said valve is in said open condition, and is prevented from being angularly displaced relative to said link about said second axis when said valve is in said closed condition, thereby permitting said implement to be angularly displaced relative to said link when said valve is opened, said implement is caused to engage an object and said handle is displaced relative to said implement, and causing said implement to maintain an angular displacement relative to said link when said valve is closed.

2. A tool assembly according to claim 1 wherein said fluid actuated assemblies are pivotally connected to said implement on opposite sides of the pivotal connection of said implement to said link.

3. A tool assembly according to claim 1 wherein said fluid actuated assemblies are pivotally connected to said link on an axis lying in a plane including said second axis.

4. A tool assembly according to claim 1 wherein said second axis lies in a plane disposed at an angle relative to said first axis.

5. A tool assembly according to claim 4 wherein said fluid actuated assemblies are pivotally connected to said implement on opposite sides of said plane.

6. A tool assembly according to claim 4 wherein said fluid actuated assemblies are pivotally connected to said link on an axis disposed in said plane.

7. A tool assembly according to claim 4 wherein said plane lies at a 90° angle relative to said first axis.

8. A tool assembly according to claim 1 wherein said valve is disposed in said first fluid line.

9. A tool assembly according to claim 1 wherein said first fluid line intercommunicates the base ends of the cylinders of said fluid actuated assemblies, and said second fluid line intercommunicates the rod ends of the cylinders of said fluid actuated assemblies.

10. A tool assembly according to claim 1 wherein said first fluid line intercommunicates the base end of the cylinder of the first fluid actuated assembly and the rod end of the cylinder of said second fluid actuated assembly, and said second fluid line intercommunicates the rod end of the cylinder of the first fluid actuated assembly and the base end of the cylinder of said second fluid actuated assembly.

11. A tool assembly according to claim 10 including an accumulator operatively connected to said fluid lines for compensating for disparities of cylinder chamber volumes.

12. A tool assembly according to claim 1 wherein said valve is a solenoid operated valve.

13. A tool assembly according to claim 12 including electrical controls disposable at an operator's station on said machine for operating said solenoid valve.

14. A tool assembly according to claim 1 wherein said implement comprises a bucket.

15. A tool assembly according to claim 14 wherein said bucket includes a material receiving opening facing forwardly relative to the machine.

16. A tool assembly according to claim 13 wherein said bucket includes a material receiving opening facing rearwardly relative to said machine.

* * * * *